US008333216B2

(12) United States Patent
Kim et al.

(10) Patent No.: US 8,333,216 B2
(45) Date of Patent: Dec. 18, 2012

(54) BLOW-OFF VALVE FOR TURBO BLOWER

(75) Inventors: Dong Kwon Kim, Daejon (KR); Cheol Ki Lee, Bucheon-si (KR)

(73) Assignee: Neuros, Co., Ltd., Daedeok (KR)

( * ) Notice: Subject to any disclaimer, the term of this patent is extended or adjusted under 35 U.S.C. 154(b) by 503 days.

(21) Appl. No.: 12/528,261

(22) PCT Filed: Apr. 10, 2008

(86) PCT No.: PCT/KR2008/002008
§ 371 (c)(1),
(2), (4) Date: Aug. 21, 2009

(87) PCT Pub. No.: WO2008/127013
PCT Pub. Date: Oct. 23, 2008

(65) Prior Publication Data

US 2010/0032601 A1 Feb. 11, 2010

(30) Foreign Application Priority Data

Apr. 11, 2007 (KR) ..... 10-2007-0035370

(51) Int. Cl.
*F16K 31/14* (2006.01)

(52) U.S. Cl. ..... 137/495; 251/30.05; 137/505.36

(58) Field of Classification Search ..... 251/25, 251/30.01, 30.02, 30.05; 137/454, 494, 495, 137/505.36, 505.38, 505.44, 596.1, 596.14, 137/596.16, 625.65
See application file for complete search history.

(56) References Cited

U.S. PATENT DOCUMENTS

| | | | | | |
|---|---|---|---|---|---|
| 436,235 | A | * | 9/1890 | Griffin | 137/495 |
| 1,764,790 | A | * | 6/1930 | Hook et al. | 137/495 |
| 1,956,977 | A | * | 5/1934 | Shawn | 137/497 |
| 2,226,761 | A | * | 12/1940 | Fox | 137/80 |
| 2,351,047 | A | * | 6/1944 | Hughes | 137/71 |
| 3,098,501 | A | * | 7/1963 | McLeod | 137/505.13 |
| 4,617,958 | A | * | 10/1986 | Seidel et al. | 137/492.5 |

(Continued)

FOREIGN PATENT DOCUMENTS

JP 2003-214599 A 7/2003

(Continued)

OTHER PUBLICATIONS

International Search Report for PCT/KR2008/002008.

*Primary Examiner* — Craig Schneider
*Assistant Examiner* — Matthew W Jellett
(74) *Attorney, Agent, or Firm* — Bachman & LaPointe, P.C.

(57) ABSTRACT

A blow-off valve for a turbo blower 1000 has a body part 100 which includes a cylinder part 110, a valve-guide plate 130 on the cylinder part 110 and a head part 150 covering the valve-guide plate 130. In the cylinder part 110, a blow-connection opening 1038 connected with a blow opening 2500 of the turbo blower 2000 and a blow-off opening 1058 to blow off the emission air from the turbo blower 2000. A spool valve 300 is provided and a blow-pressure spool 380 is located at space connected with the blow-connection opening 1038 and a blow-pressure opposing spool 330 is located between the valve-guide plate 130 and the head part 150 and a stem of the spool valve penetrates the valve-guide plate 130 and is supported thereby. A three-way solenoid valve 20 is mounted on the head part 150.

6 Claims, 6 Drawing Sheets

U.S. PATENT DOCUMENTS

| | | | | |
|---|---|---|---|---|
| 5,002,398 | A * | 3/1991 | Musil | 366/7 |
| 5,288,052 | A * | 2/1994 | Black et al. | 251/30.01 |
| 5,301,504 | A | 4/1994 | Bertling et al. | |
| 6,684,898 | B2 * | 2/2004 | Wiggins et al. | 137/15.25 |
| 6,752,169 | B2 * | 6/2004 | Callies | 137/495 |
| 6,832,625 | B2 * | 12/2004 | Ford | 137/495 |
| 6,889,731 | B2 | 5/2005 | Vallon et al. | |
| 6,923,205 | B2 * | 8/2005 | Callies | 137/495 |
| 6,968,923 | B2 * | 11/2005 | Schmaeman | 181/252 |
| 7,147,430 | B2 * | 12/2006 | Wiggins et al. | 415/19 |
| 2004/0163721 | A1 * | 8/2004 | Cotton et al. | 137/625.65 |
| 2005/0061010 | A1 | 3/2005 | Mu et al. | |
| 2005/0183783 | A1 * | 8/2005 | Holmes et al. | 137/625.65 |
| 2007/0267077 | A1 * | 11/2007 | Nagasaki et al. | 137/625.65 |

FOREIGN PATENT DOCUMENTS

| | | | |
|---|---|---|---|
| KR | 1995-0010484 | Y1 | 12/1995 |
| KR | 10-2004-0043796 | A | 5/2004 |

* cited by examiner

BLOW-OFF VALVE FOR TURBO BLOWER

FIELD OF THE INVENTION

The present invention relates to a blow-off valve for a turbo blower and, more particularly, to the blow-off valve for the turbo blower which blows off emission air to the atmosphere at early operation stage of the turbo blower.

BACKGROUND

The turbo blower is a machine which revolves an impeller at high speed by means of a motor to draw external air and blow it. The turbo compressor is the same machine as the turbo blower, however, the term of the turbo compressor is used when the discharging pressure is high. If the pressure is less than 1 bar we usually call it turbo blower and if the pressure is over 1 bar we usually call it turbo compressor.

The turbo blower is generally used for pneumatic conveying or aeration at a sewage disposal plant so on and the turbo compressor is used for pneumatic conveying or supplying pressurized air to pneumatic equipment and so on.

In the present invention, the term of the turbo blower includes the turbo compressor.

The pressure of the emission air is low at early stage of operation of the turbo blower since the motor does not reach the steady state and it is difficult to use the air. For example, the emission air pressure at the early stage is too low to use for the aeration. Accordingly, the air is blown off to the atmosphere until the motor reaches the steady state. After the motor reaches the steady state, the air is emitted to the originally-intended place.

For this purpose, conventionally, a butterfly valve has been used, which requires a compressor and an actuator. The compressor generates high pressure air to operate the actuator for the butterfly valve. The actuator operates the butterfly valve to blow off the air at the early stage of the turbo blower and emit the air to the originally-intended place after the turbo blower reaches the steady state.

However, in this case, electricity rates are wasted for the operation of the compressor. Further, the compressor may cause a problem, which leads to the problem of the turbo blower. Furthermore, tube connecting the compressor and the butterfly valve occupy space, the length of the tube may be the problem and installation of a separated power source is required for the operation of the compressor, all which causes complication. Therefore, it is desirable if the blow-off the air is performed without the compressor. The present invention satisfies this demand.

DISCLOSURE

Technical Problem

The purpose of the present invention is to provide a blow-off valve which can blow off the air to the atmosphere at the early stage of the turbo blower without the compressor.

Technical Solution

The present invention provides a blow-off valve for a turbo blower comprising: a body part including a blow-connection opening connected with a blow opening of a turbo blower and a blow-off opening through which air emitted from the turbo blower through the blow-connection opening is blown off; a spool valve provided in the inner part of the body part having a blow-pressure spool located at a blow-pressure supply space formed in the inner part of the body part and connected with the blow-connection opening and a blow-pressure opposing spool located at a blow-pressure opposing space formed in the opposite space to the blow-pressure supply space; wherein pressure applying area of the blow-pressure spool is smaller than that of the blow-pressure opposing spool and the blow-off opening is formed between the blow-pressure spool and the blow-pressure opposing spool of the spool valve; and a three-way valve provided in the body part having a port connected with the blow-pressure supply space, a port connected with the blow-pressure opposing space and a port connected with an external atmosphere, the three-way valve shutting off the port connected with the blow-pressure supply space to connect the blow-pressure opposing space and the external atmosphere at early operation stage of the turbo blower and shutting off the off the port connected with the external atmosphere to connect the blow-pressure supply space and the blow-pressure opposing space.

In this case, it is desirable if the blow-pressure opposing spool is formed by a diaphragm.

In this case, it is desirable if the three-way valve is a three-way solenoid valve.

In this case, it is desirable if the body part has a cylinder part and a valve-guide plate through which a stem of the spool valve penetrate and is supported, the valve-guide plate mounted on the cylinder part, and a head part mounted on the valve-guide plate for covering the valve-guide plate; and the blow-pressure spool is located at the cylinder part and the blow-pressure opposing spool is located between the vale-guide plate and the head part.

In this case, it is desirable if an atmosphere connection opening is formed on the side of the valve-guide plate to communicate with the external atmosphere.

In this case, it is desirable if cross section of the valve-guide plate is nearly U-shape and the internal space of the upper portion of the valve-guide plate becomes larger.

In this case, it is desirable if the three-way valve is mounted on the head part and a ring is mounted on lower surface of the head part, an area formed inside the ring being larger than the pressure applying area of the blow-pressure spool.

Advantageous Effects

The present invention provides the blow-off valve which can blow off the emission air from the turbo blower by means of the emission air itself and without the compressor. Especially, the spool in the blow-pressure opposing space is formed by the diaphragm and the rapid response with the short stroke is assured.

MODE FOR INVENTION

Now, a preferred embodiment of the present invention is described with reference to the accompanying drawings.

Figure 1:
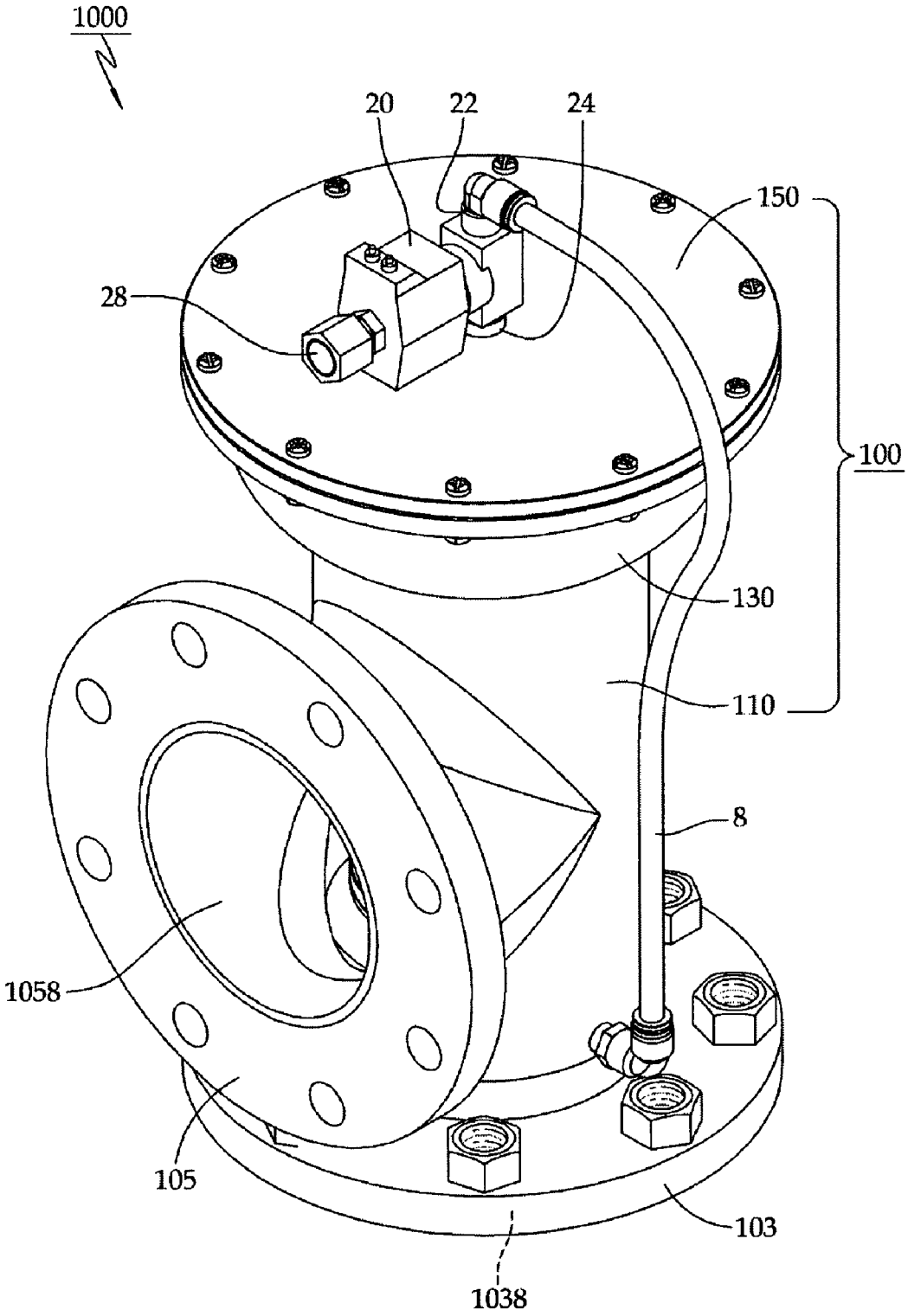
FIG. 1 shows an external appearance of a blow-off valve according to the embodiment of the present invention.

FIG. 1 shows an external appearance of a blow-off valve 1000 according to the embodiment of the present invention.

Firstly, the blow-off valve 1000 has a body part 100. The body part 100 includes a cylinder part 110 and a valve-guide plate 130 on the cylinder part 110 and a head part 150 mounted on the valve-guide plate 130.

It is preferable if the cross section of the valve-guide plate 130 is nearly U-shape and the internal space of the upper portion becomes larger.

According to the present invention, a blow-connection opening 1038 connected with a blow opening 2500 of the turbo blower 2000 is formed on the body part 100.

Further, a blow-off opening 1058 through which the emitting air from the blow-connection opening 1038 is blown off is formed on the body part 100.

In the embodiment, the blow-connection opening 1038 and the blow-off opening 1058 are all formed on the cylinder part 110 and, especially, the blow-connection opening 1038 is formed on the bottom of the cylinder part 110 and the blow-off opening 1058 is formed on the side of the cylinder part 110 with reference to FIG. 1.

Figure 6:
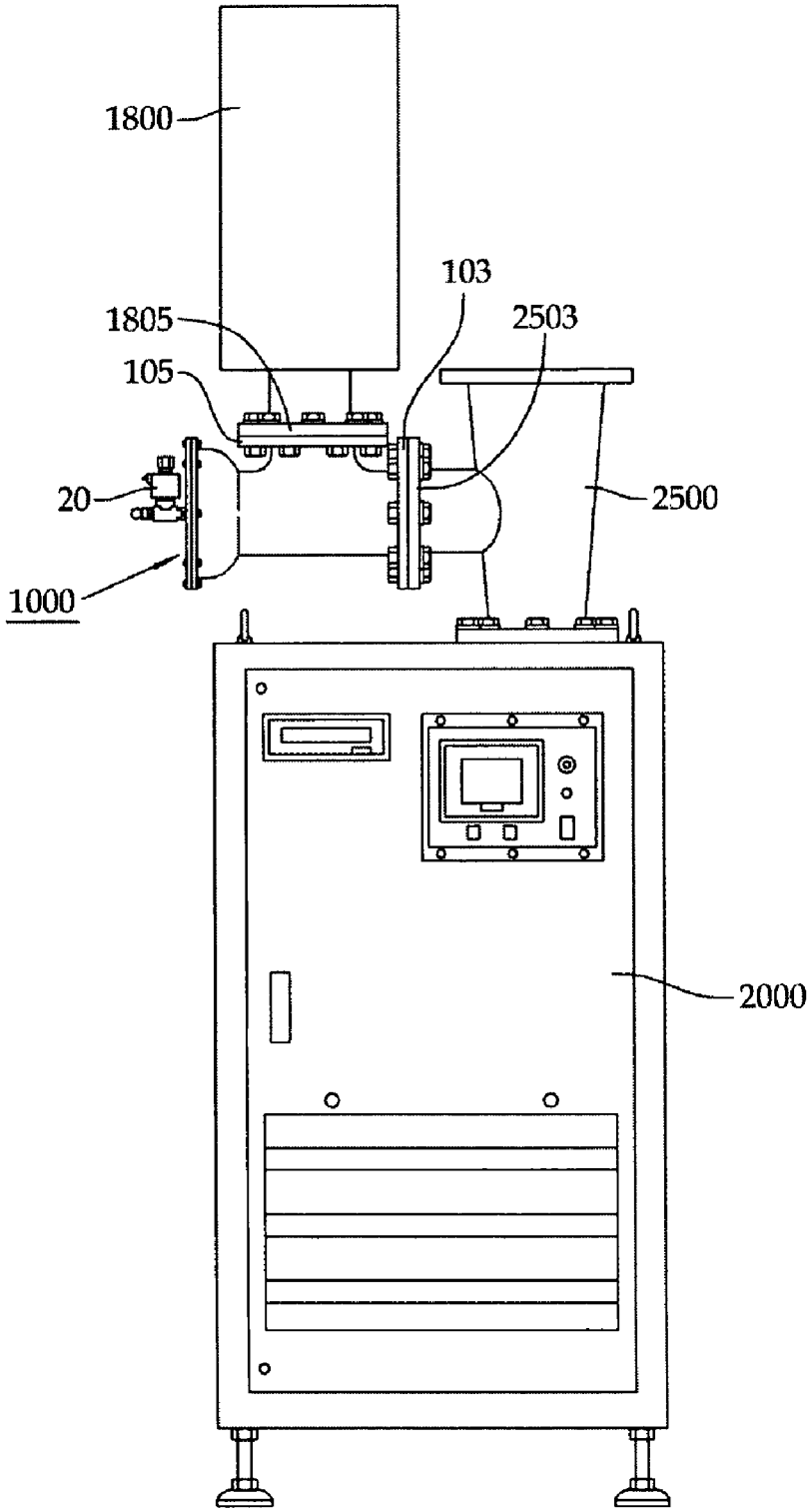
FIG. 6 shows an installation example of the blow-off valve on the turbo blower.

According to the embodiment, flanges 103 and 105 are formed around the blow-connection opening 1038 and the blow-off opening 1058, respectively and they are connected with flanges 2053 and 1805 around the blow opening 2500 of the turbo blower 2000 and a silencer 1800, respectively. (Refer to FIG. 6)

Accordingly, the emitting air emitted through the blow opening 2500 of the turbo blower 2000 flows into the body part 100 through the blow-connection opening 1038, and then is blown off through the blow-off opening 1058 to the external atmosphere after the suppression of noise by means of the silencer 1800.

According to the present invention, a three-way valve 20 is provided in the body part 100 to connect blow-pressure supply space 51, blow-pressure opposing space S2 and the external atmosphere external to the body part 100. In this embodiment, solenoid valve is provided as the three-way valve 20 and the solenoid valve 20 is mounted on the head part 150 of the body part 100.

As described later, in the solenoid valve 20, a port 22 is connected to the blow-pressure supply space 51 through a tube 8 and a port 24 is connected to the blow-pressure opposing space S2 by perforating the head part 150, and an air vent 28 is connected to the external atmosphere.

Figure 2:
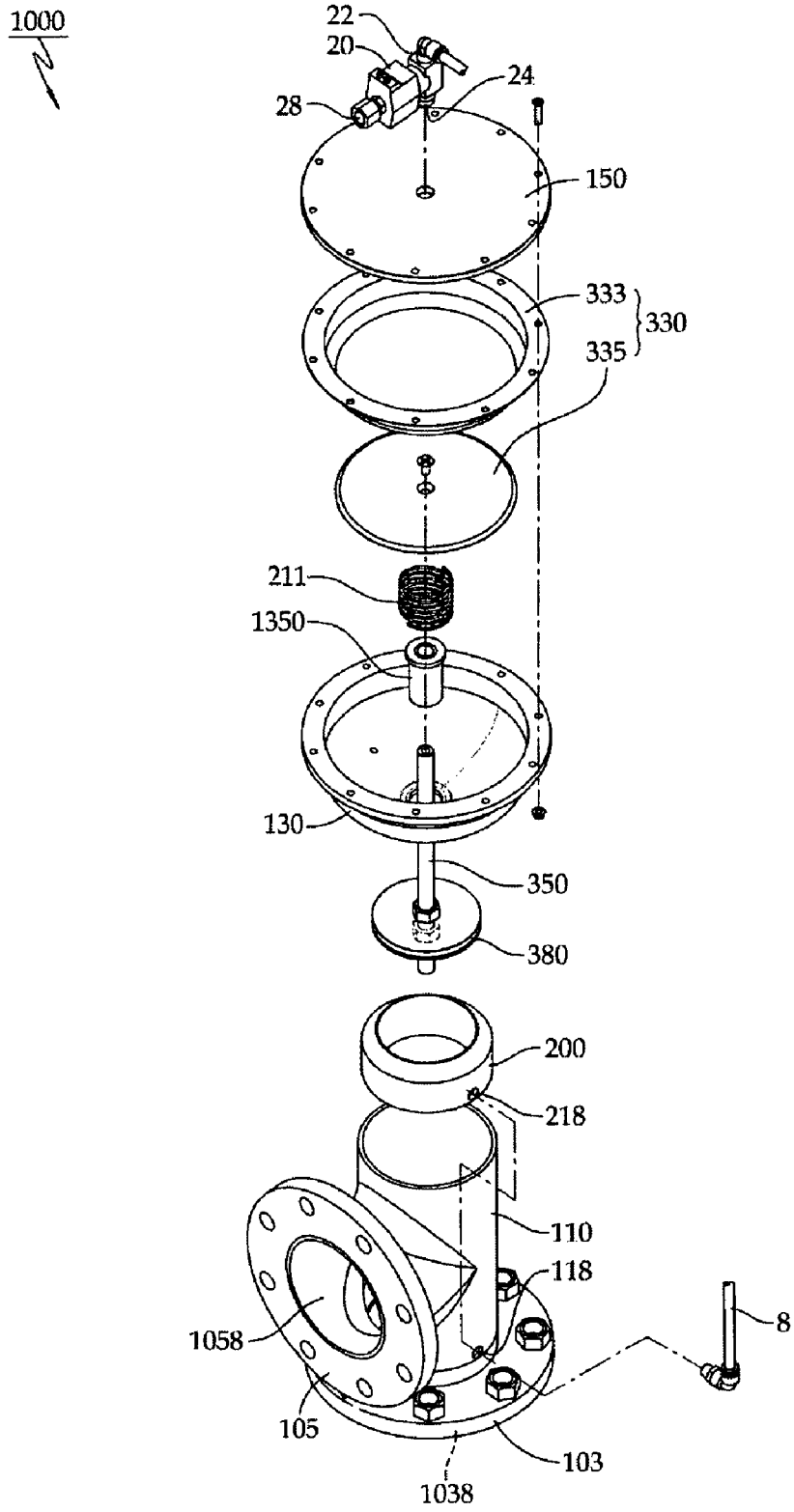
FIG. 2 shows an exploded view of the blow-off valve.
Figure 3:
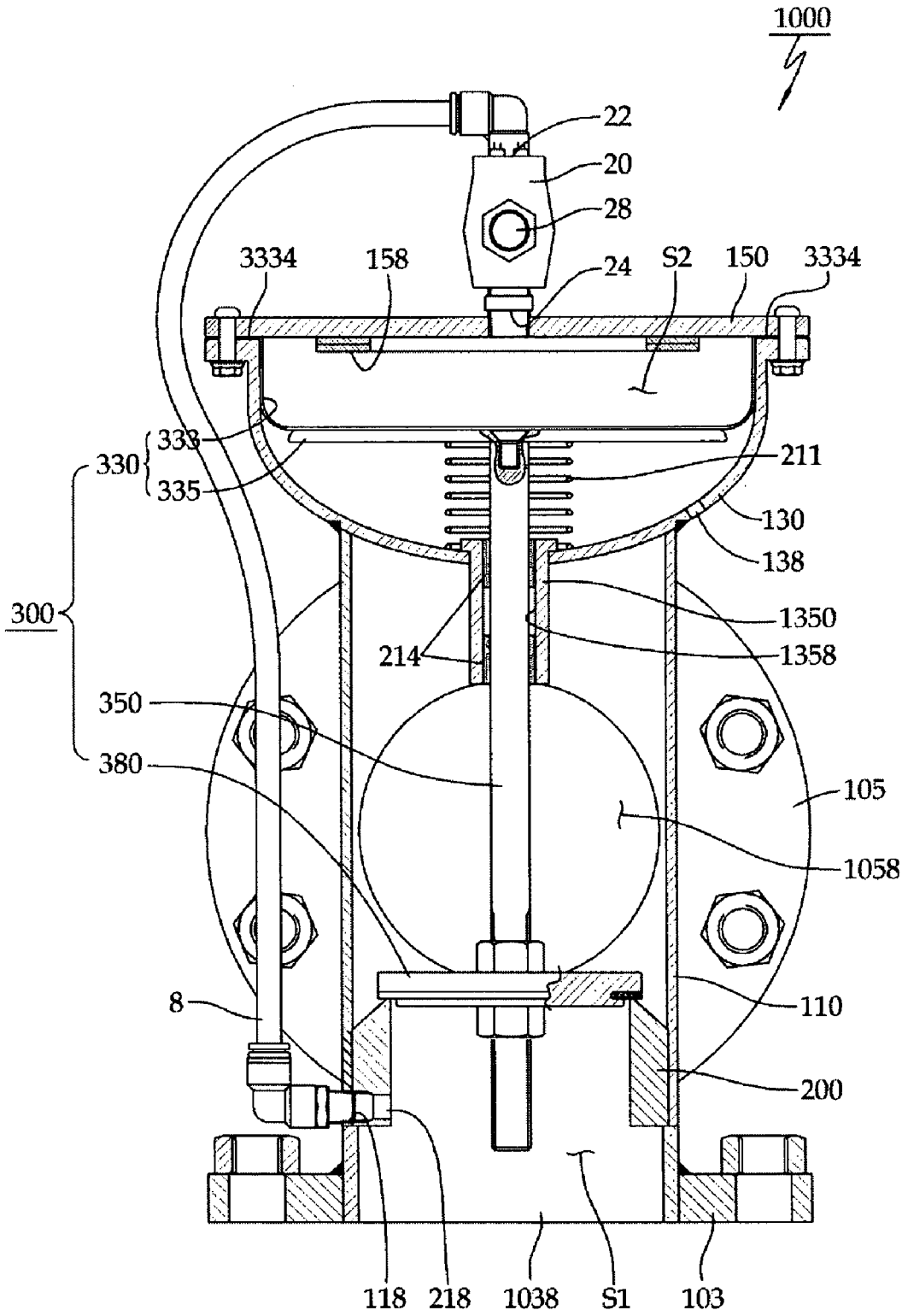
FIG. 3 shows a front sectional view of the blow-off valve.
Figure 4:
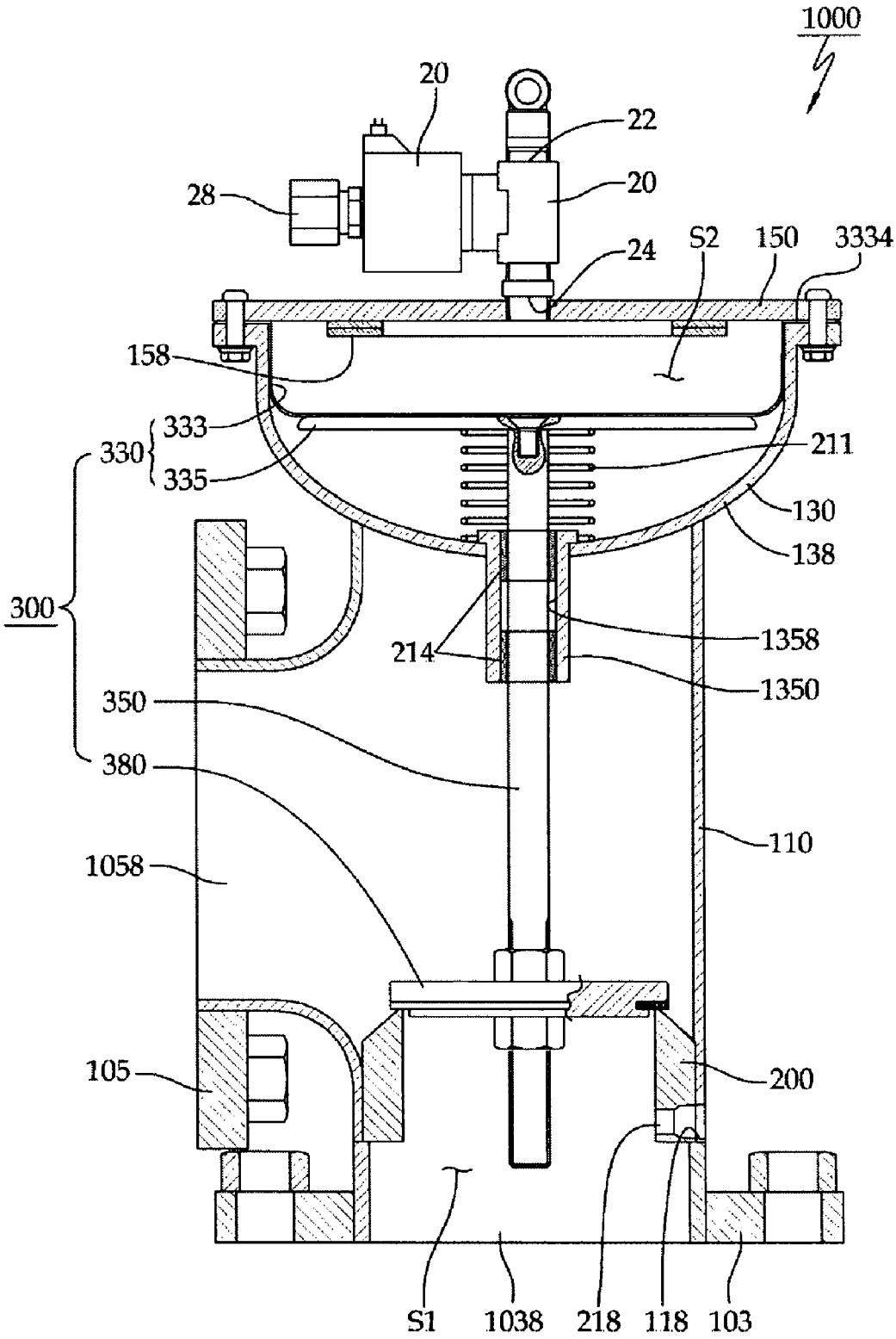
FIG. 4 shows a side sectional view of the blow-off valve.
Figure 5:
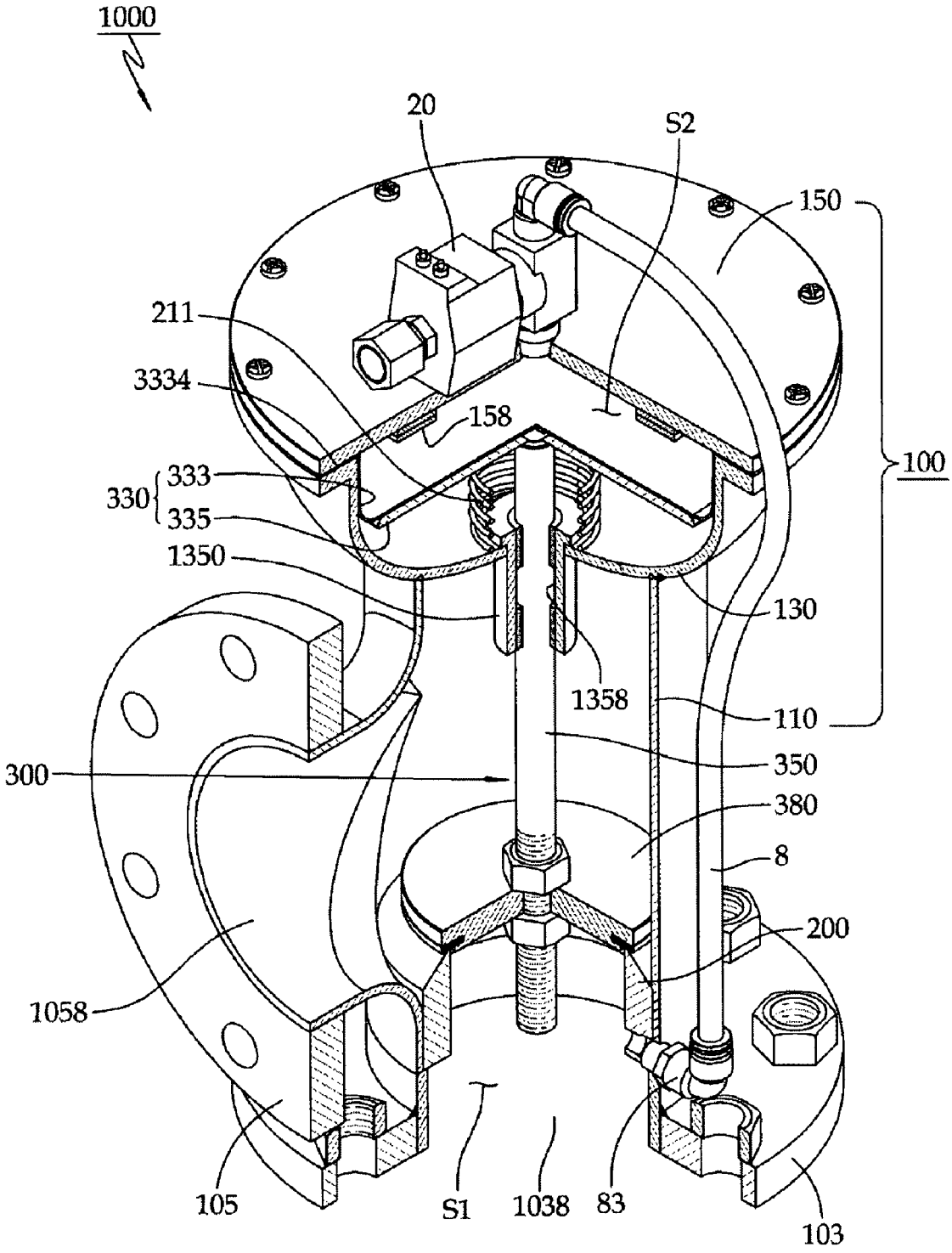
FIG. 5 shows a partially broken away perspective view of the blow-off valve.

FIGS. 2 to 5 show the internal structure of the blow-off valve 1000 according to the embodiment of the present invention. Specifically, FIG. 2 shows an exploded view of the blow-off valve 1000, FIG. 3 shows a front sectional view of the blow-off valve 1000, FIG. 4 shows a side sectional view of the blow-off valve 1000 and FIG. 5 shows a partially broken away perspective view of the blow-off valve 1000.

As shown, the blow-connection opening 1038 is formed on the bottom of the cylinder part 110.

A support ring 200 is provided in the inner part of the cylinder part 110 and the valve-guide plate 130 is mounted on the cylinder part 110. As shown, an opening is formed on the center of the valve-guide plate 130 and a guide part 1350 in which a hollow portion 1358 is formed is provided in the opening on the center of the valve-guide plate 130.

According to the present invention, a disk valve 300 is provided in the inner part of the body part 100. In this embodiment, in the disk valve 300, a disk 380 is located on the support ring 200 in the inner part of the cylinder part 110 and an opposite disk 330 is located in the space formed by the valve-guide plate 130 and the head part 150. A stem 350 connecting the disks 380 and 330 is placed through the hollow portion 1358 of the guide part 1350 in the valve-guide plate 130. At this time, bushings 214 are arranged at the hollow portion 1358 of the guide part 1350 in the valve-guide plate 130.

In this case, an internal space of the cylinder part 110 between the disk 380 and the blow-connection opening 1038 forms blow-pressure supply space 51. An internal space between the head part 150 and the disk 330 in the inner part of the body part 100 forms the blow-pressure opposing space S2 and the pressure which opposes the pressure in the blow-pressure supply space 51 is formed therein.

According to the present invention, the disk 330 may include a diaphragm 333 and a plate 335 contacting the lower surface of the diaphragm 333.

In this case, the circumferential part of diaphragm 333 is placed between the contacting surfaces of the head part 150 and the valve-guide plate 130 and the disk 330 is mounted.

As described, the disk 330 is formed by the diaphragm 333 so that the disk valve 300 can move with a short stroke and the response is very rapid.

In this embodiment, a spring 211 is mounted on the on the stem 350 below the plate 335 in the space between the valve-guide plate 130 and the head part 150. Accordingly, more rapid response of the disk valve 300 is assured.

According to the embodiment, the disk 380 is located in the inner part of the cylinder part 110 and the disk 330 is located in the inner part of the valve-guide plate 130 and is in contact with the inner surface thereof. In the valve-guide plate 130, the cross section is nearly U shape and the internal space of the upper portion becomes larger. Accordingly, pressure applying area of the disk 330 which is in contact with the inner surface of the valve-guide plate 130 is larger than that of the disk 380.

In this embodiment, the blow-off opening 1058 is formed between the disks 330 and 380 on the side of the cylinder part 110 of the body part 100.

According to the present invention, the three-way valve 20 is provided in the body part 100 to connect the blow-pressure supply space 51, the blow-pressure opposing space S2 and the external atmosphere.

In this embodiment, the solenoid valve mounted on the head part 150 of the body part 100 is provided as the three-way valve 20. The port 22 of the solenoid valve 20 is connected to the blow-pressure supply space 51 through the tube 8 and the port 24 of the solenoid valve 20 is connected to the blow-pressure opposing space S2 by perforating the head part 150, and the air vent 28 of the solenoid valve 20 is connected to the external atmosphere.

To connect the tube 8 with the blow-pressure supply space 51 in the cylinder part 110 of the body part 100, as shown, through holes 218 and 118 are formed on the support ring 200 and the cylinder part 110, respectively and a fitting member of the tube 8 is fitted through the through holes 218 and 118.

Further, an atmosphere connection opening 138 is formed on the side of the valve-guide plate 130 to communicate with the external atmosphere.

The operation of the blow-off valve 1000 having the described structure is, now, explained.

At the early operation stage of the turbo blower 2000, if the revolution power of the motor is weak and there is a need to blow off the emission air from the turbo blower 2000, the solenoid valve 20 shuts off the port 22 in connection with the blow-pressure supply space 51 and makes the blow-pressure opposing space S2 communicate with the external atmosphere.

At this state, the emission air from the turbo blower 2000 flows into the blow-pressure supply space 51 through the blow-connection opening 1038.

At this time, whereas the pressure in the blow-pressure opposing space S2 is at the external atmosphere pressure, the blow-pressure supply space 51 is at the emission pressure from the turbo blower 2000 so that the disk 380 of the disk valve 300 moves and the blow-connection opening 1038 and the blow-off opening 1058 are connected. As a result, the emission air is blown off through the blow-off opening 1058.

Then, if the operation of the turbo blower reaches the steady state, the solenoid valve 20 shuts off the port 28 to the external atmosphere and connects the blow-pressure supply space S1 and blow-pressure opposing space S2.

In this case, the pressure in the blow-pressure opposing space S2 becomes almost same as the pressure in the blow-pressure supply space 51.

Since the pressure applying area of the disk 330 is larger than that of the disk 380 so that the disk valve 300 moves to close the disk 380. Accordingly, the emission air in the blow-pressure supply space 51 from the turbo blower 2000 is no longer blown off and is sent to blow opening 2500.

In this case, since the air between the disk 330 and the valve-guide plate 130 is communicated with the external atmosphere through the atmosphere connection opening 138, the disk 330 rapidly moves to close the bottom disk 380.

At this time, the disk 330 is formed by the diaphragm 333 and the rapid response with the short stroke is assured, as described. If a sealing member is provided for preventing leakage between the disk 380 and the support ring 200 below the disk 380, it is preferable.

In this embodiment, on the lower surface of the head part 150, a ring 158 is mounted to guarantee minimum pressure applying area for the disk 330.

If the ring is not provided, when the disk 330 contacts the lower surface of the head part 150, the pressure applying area may become the area corresponding to the port 24 of the solenoid valve 20 and the pressure applying area in the blow-pressure opposing space S2 may be smaller than that in the blow-pressure supply area 51, which leads to malfunction of the blow-off valve 1000.

The ring 158 prevents the malfunction. The area formed inside the ring should be larger than the pressure applying area of the disk 380.

As described above, the present invention provides the blow-off valve which can blow off the emission air from the turbo blower by means of the emission air itself and without the compressor. Especially, the disk 330 in the blow-pressure opposing space S2 is formed by the diaphragm 333 and the rapid response with the short stroke is assured.

Therefore, it is understood that the purpose of the present invention is accomplished.

The present invention is described with reference to the specific embodiments, but the invention is not limited thereto. Only the following claims will determine the scope of the invention.

The invention claimed is:

1. A blow-off valve for a turbo blower comprising:

(a) a body part including a cylinder part, a valve-guide plate mounted on the cylinder part, and a head part mounted on the valve-guide plate for covering the valve-guide plate, wherein the cylinder part includes a blow-connection opening connected with a blow opening of a turbo blower and a blow-off opening connected with the blow-connection opening to blow off air emitted from the turbo blower through the blow-connection opening;

(b) a disk valve having a blow-pressure disk located between the blow-connection opening and the blow-off opening in the cylinder part, a blow-pressure opposing disk located between the valve-guide plate and the head part, and a stem which penetrates the valve-guide plate and couples the blow-pressure disk and the blow-pressure opposing disk, wherein an internal space of the cylinder part between the blow-pressure disk and the blow-connection opening forms blow-pressure supply space and an internal space between the head part and the blow-pressure opposing disk forms blow-pressure opposing space, and a pressure applying area of the blow-pressure disk is smaller than a pressure applying area of the blow-pressure opposing disk; and (c) a three-way valve provided in the body part having a port connected with the blow-pressure supply space, a port connected with the blow-pressure opposing space and a port connected with an external atmosphere external to the body part, the three-way valve shutting off the port connected with the blow-pressure supply space to connect the blow-pressure opposing space and the external atmosphere at early operation stage of the turbo blower so that the blow-pressure disk of the disk valve moves to open the connection of the blow-connection opening and the blow-off opening and shutting off the port connected with the external atmosphere to connect the blow-pressure supply space and the blow-pressure opposing space so that the blow-pressure disk of the disk valve moves to close the connection of the blow-connection opening and the blow-off opening wherein the three-way valve is mounted on the head part and a ring is mounted on the lower surface of the head part, an area formed inside the ring being larger than the pressure applying area of the blow-pressure disk; wherein the port of the three way valve connected with the blow-pressure opposing space is directly attached to a center portion of the head part and the ring further comprises a two layer arrangement centered on the center portion of the head part and in axial alignment with the port of the three way valve connected with the blow-pressure opposing space so as to provide the pressure applying area to the inside of the ring when the blow-pressure disk moves to close the connection of the blow-connection opening and the blow-off opening.

2. The blow-off valve for the turbo blower as claimed in claim 1 wherein the blow-pressure opposing disk is formed by a diaphragm.

3. The blow-off valve for the turbo blower as claimed in claim 2 wherein the three-way valve is a three-way solenoid valve.

4. The blow-off valve for the turbo blower as claimed in claim 1 wherein the three-way valve is a three-way solenoid valve.

5. The blow-off valve for the turbo blower as claimed in claim 1 wherein an atmosphere connection opening is formed on the side of the valve-guide plate to communicate with the external atmosphere.

6. The blow-off valve for the turbo blower as claimed in claim 1 wherein a cross-section of the valve-guide plate is nearly U-shape and the internal space of the upper portion of the valve-guide plate becomes larger.

* * * * *